US010076762B2

(12) United States Patent
Muller

(10) Patent No.: US 10,076,762 B2
(45) Date of Patent: Sep. 18, 2018

(54) FLUID PRODUCT DISPENSER

(71) Applicant: APTAR FRANCE SAS, Le Neubourg (FR)

(72) Inventor: Patrick Muller, Saint Aubin sur Gaillon (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/304,314

(22) PCT Filed: Apr. 14, 2015

(86) PCT No.: PCT/FR2015/050995
§ 371 (c)(1),
(2) Date: Oct. 14, 2016

(87) PCT Pub. No.: WO2015/159013
PCT Pub. Date: Oct. 22, 2015

(65) Prior Publication Data

US 2017/0036227 A1 Feb. 9, 2017

(30) Foreign Application Priority Data

Apr. 16, 2014 (FR) ..... 14 53418

(51) Int. Cl.
*B05B 11/00* (2006.01)
*B05B 15/00* (2018.01)
(Continued)

(52) U.S. Cl.
CPC ..... *B05B 11/3081* (2013.01); *B01F 15/0087* (2013.01); *B01F 15/0206* (2013.01);
(Continued)

(58) Field of Classification Search
CPC ..... B05B 11/3081; B05B 11/0048; B05B 11/0078; B05B 15/008; B05B 15/002;
(Continued)

(56) References Cited

U.S. PATENT DOCUMENTS 1,965,690 A * 7/1934 Creveling ..... F16N 3/12 222/259
4,220,261 A * 9/1980 White ..... B05C 17/00559 222/135
(Continued)

FOREIGN PATENT DOCUMENTS

DE 20 2010 013 855 U1 1/2012
EP 0 112 574 A1 7/1984
(Continued)

OTHER PUBLICATIONS

International Search Report of PCT/FR2015/050995 dated Jul. 30, 2015.
(Continued)

*Primary Examiner* — Frederick C Nicolas
(74) *Attorney, Agent, or Firm* — Sughrue Mion, PLLC

(57) ABSTRACT

A dispenser having a fluid reservoir (R) and a dispenser member (D) mounted on the reservoir (R), the reservoir (R) forming a cylinder (11) and including a piston (2; 2') that slides in the cylinder (11) so as to decrease the working volume of the reservoir (R). The leaktight slide cylinder (11) contains a separator element (3*a*) that divides the reservoir into two compartments (Ri, Rs), namely a lower compartment (Ri) that is defined between the piston (2; 2') and the separator element (3*a*), and an upper compartment (Rs) that is defined between the separator element (3*a*) and the dispenser member (D). The separator element (3*a*) includes at least one through hole (33) that puts the two compartments (Ri, Rs) into communication with each other, the separator element moving in the leaktight slide cylinder in
(Continued)

Figure 1:
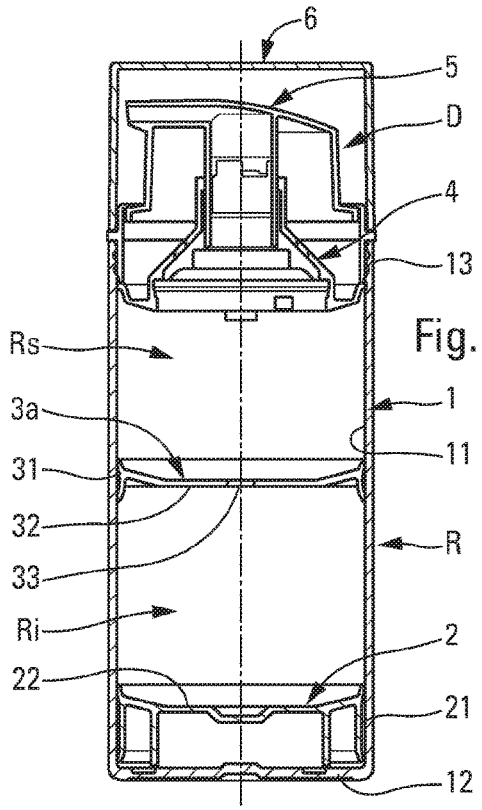

response to the dispenser member being actuated by pressing on the pusher.

19 Claims, 1 Drawing Sheet

(51) Int. Cl.

| | |
|---|---|
| ***B01F 15/00*** | (2006.01) |
| ***B01F 15/02*** | (2006.01) |
| ***B05B 15/40*** | (2018.01) |
| *B05C 17/005* | (2006.01) |
| *B05B 15/20* | (2018.01) |

(52) U.S. Cl.
CPC ..... *B01F 15/0224* (2013.01); *B01F 15/0237* (2013.01); *B05B 11/0048* (2013.01); *B05B 11/0078* (2013.01); *B05B 15/40* (2018.02); *B05B 15/20* (2018.02); *B05C 17/00563* (2013.01)

(58) Field of Classification Search
CPC ..... B05B 15/20; B05B 15/40; B01F 15/0087; B01F 15/0206; B01F 15/0224; B01F 15/0237; B05C 17/00563
See application file for complete search history.

(56) References Cited

U.S. PATENT DOCUMENTS

| | | | | |
|---|---|---|---|---|
| 4,334,787 | A * | 6/1982 | Kluth | G05D 11/132 222/319 |
| 5,273,189 | A * | 12/1993 | Jouillat | B05B 11/0005 222/129 |
| 8,672,186 | B2 * | 3/2014 | Geiberger | B05B 11/0048 222/129 |
| 2011/0068123 | A1 * | 3/2011 | Geiberger | B05B 11/0048 222/135 |
| 2013/0299515 | A1 | 11/2013 | Geiberger | |

FOREIGN PATENT DOCUMENTS

| | | |
|---|---|---|
| EP | 1 498 362 A1 | 1/2005 |
| EP | 1 955 779 A1 | 8/2008 |
| FR | 95 834 E | 7/1971 |
| FR | 2 660 212 A1 | 10/1991 |

OTHER PUBLICATIONS

International Preliminary Examination Report on Patentability issued from the International Bureau in counterpart International Application No. PCT/FR2015/050995, dated Nov. 3, 2016.

* cited by examiner

FLUID PRODUCT DISPENSER

CROSS REFERENCE TO RELATED APPLICATIONS

This application is a National Stage of International Application No. PCT/FR2015/050995 filed Apr. 14, 2015, claiming priority based on French Patent Application No. 14 53418 filed Apr. 16, 2014, the contents of all of which are incorporated herein by reference in their entirety.

The present invention relates to a fluid dispenser comprising a fluid reservoir and a dispenser member, such as a pump or a valve, that is mounted on the reservoir, the dispenser member including a pusher for actuating it, the reservoir forming a leaktight slide cylinder and including a piston that slides in the cylinder in response to the dispenser member being actuated by pressing on the pusher, so as to decrease the working volume of the reservoir and keep the fluid out of contact with the outside air. The piston may be a follower piston that moves in the slide cylinder of the reservoir when the fluid contained in the reservoir is subjected to suction. That happens when the pump sucks fluid into its pump chamber from the reservoir. That type of fluid dispenser is frequently used in the fields of cosmetics and pharmacy in order to dispense fluids that are generally viscous, such as creams, gels, pomades, etc. However, it is also possible to use such a dispenser for dispensing lower-viscosity fluids, e.g. lotions, perfumes, etc.

In the prior art, numerous fluid dispensers are already known that are suitable for dispensing a plurality of fluids in mixed, simultaneous, or parallel form. The fluids may be mixed together at the pump or at a dispenser head. It is also possible to mix the fluids together upstream from the pump. When the fluids are mixed together directly inside a reservoir, this is referred to as "extemporaneous" mixing. The fluids are stored separately in reservoirs having distinct compartments, and an initial or prior manipulation of the dispenser makes it possible to put the two reservoirs into communication with each other so as to enable the fluids to be mixed together.

In the prior art, it is also known to use two completely distinct reservoirs, each provided with a respective follower piston, for dispensing two fluids that are mixed together at the pump or at the dispenser head.

An object of the present invention is to propose a novel type of fluid dispenser that makes it possible to mix the fluids stored in the reservoir in an original manner. An object of the present invention is to mix the fluids together in a single reservoir that is provided with a follower piston. Another object of the present invention is to be able to control the fluid mixing stage with greater accuracy. Still another object of the present invention is to be able to use the present invention in a standard or conventional follower-piston dispenser. Still another object of the present invention is to mix the fluids together progressively, and not mix them together instantaneously.

To do this the present invention proposes that the leaktight slide cylinder further contains a separator element that divides the reservoir into two compartments, namely a lower compartment that is defined between the piston and the separator element, and an upper compartment that is defined between the separator element and the dispenser member, the separator element including at least one through hole that puts the two compartments into communication with each other, the element moving in the leaktight slide cylinder in response to the dispenser member being actuated by pressing on the pusher.

It should be observed that the through hole is a structural characteristic that is inherent to the separator element and that does not come from prior manipulation of the dispenser. In other words, the through hole may already be present, even when the dispenser has yet to be used. The separator element separates the two compartments of the reservoir, while forming a communication passage through the hole. For fluids that present a certain amount of viscosity, the fluids mix together when a fluid is forced through the through hole. This occurs when the dispenser is actuated, thereby causing the follower piston to move, thus creating a pressure differential between the two compartments of the reservoir. The fluid of one compartment is thus pushed through the through hole into the other compartment in which it mixes with the fluid therein.

In an aspect of the present invention, the separator element may slide in leaktight manner in the slide cylinder. Thus, the separator element is similar to a piston, in the same way as the follower piston. In a variant, the separator element may merely be in the form of a disk having a peripheral edge that comes into contact with the cylinder, without being completely sealed. It may even be envisaged that the through hole is formed by an annular gap formed between the peripheral edge of the separator element and the slide cylinder. The number and the shape of the through holes may be extremely varied.

According to another characteristic of the present invention, each compartment contains a different fluid. The fluids may differ in their viscosities, their compositions, their properties, their colors, their transparencies/opacities. Advantageously, the fluid of the lower compartment presents viscosity that is lower than the viscosity of the fluid of the upper compartment. Thus, when the piston moves, the lower viscosity fluid stored in the lower compartment is pushed through the through hole(s) of the separator element, and it may thus mix with the higher viscosity fluid stored in the upper compartment. This is merely one non-limiting but advantageous embodiment.

In another aspect of the invention, the separator element moves simultaneously with the piston. In other words, the movement of the separator element is directly dependent on the movement of the piston.

In a particularly advantageous embodiment, the separator element includes a filter. Thus, the separator element could allow only a fraction of the fluid stored in one of the compartments to pass, the other fraction of the fluid remaining in said compartment. In this configuration, it may be envisaged that the separator element is mounted in stationary manner inside the slide cylinder.

In another embodiment of the invention, the lower compartment may contain microcapsules that are broken on passing through the through hole. It is also possible to envisage that the microcapsules are broken by the separator element before passing through the through hole.

In still another embodiment of the invention, the lower compartment may contain at least one capsule containing a substance, and the separator element and/or the follower piston may include perforator means that are suitable for perforating the capsule so as to diffuse the substance into the fluid. By way of example, the perforator means are in the form of spikes or teeth.

In the context of the present invention, it may also be envisaged to use a plurality of separator elements that are superposed in the slide cylinder in such a manner as to divide the reservoir into three or more compartments. It is thus possible in a single reservoir to store a plurality of different fluids that may be mixed together in a determined sequence and in determined amounts.

In a practical embodiment, the dispenser includes a plurality of separator elements that are superposed in the cylinder in such a manner as to divide the reservoir into three or more compartments.

In a practical embodiment, the separator element is in the form of a disk with at least one leaktight-sliding lip on its outer periphery. Advantageously, the separator element may include a portion that is conical and/or cylindrical.

The piston may be a follower piston that moves when the reservoir is subjected to suction, or a pusher piston that is resiliently biased by a spring or by a propellant gas.

The spirit of the invention resides in having a separator element that is permeable to the fluid inside a slide cylinder of a reservoir. The invention applies very particularly to a dispenser including a follower-piston reservoir, but it may also be applied to any other type of reservoir including a piston that is resiliently biased, e.g. by a spring or by gas. Instead of the pump, a dispenser valve may thus be used.

The invention is described more fully below with reference to the accompanying drawing which shows several embodiments of the invention as non-limiting examples.

In the figures:

FIG. 1 is a vertical section view through a fluid dispenser in a first embodiment of the invention; and FIGS. 2*a*, 2*b*, 2*c*, 3, 4, 5, 6, and 7 show other embodiments of the invention.

Reference is made firstly to FIG. 1 in order to describe a fluid dispenser incorporating the invention in a first embodiment. The dispenser comprises a reservoir R including an opening 13 in which there is mounted, in stationary and leaktight manner, a dispenser member D that may be a pump or a valve.

The fluid reservoir R comprises a shell 1 that is made of a relatively rigid material. At its bottom end, the shell 1 includes a bottom wall 12 that is optionally perforated by a vent hole. At its opposite end, the shell 1 forms the opening 13 in which the dispenser member D is engaged. Between the bottom wall 12 and the opening 13, the shell forms a leaktight slide cylinder 11 that is of shape that is cylindrical, advantageously circularly cylindrical. In the embodiment shown in FIG. 1, the opening 13 extends in alignment with the slide cylinder 11. However, without going beyond the ambit of the invention, it is possible to envisage that the opening 13 forms a constriction in the form of a neck of diameter that is smaller than the diameter of the cylinder 11.

The reservoir R also includes a follower piston 2 that is engaged inside the cylinder 11 in such a manner as to be able to slide in leaktight manner. In entirely conventional manner, the follower piston 2 may include one or two sealing lips 21 that are in leaktight engagement with the cylinder 11. The follower piston 2 also includes a plate 22 that extends inwards from the lip(s) 21. In its initial position, the follower piston 2 is arranged in the proximity of, or in contact with, the bottom wall 12, such that the major portion of the working volume of the reservoir R is arranged above the follower piston 2. This design is entirely conventional for a fluid reservoir incorporating a follower piston.

The dispenser member D, which in this embodiment is a pump, may present a design that is entirely conventional. By way of example, it may comprise a body 4 surmounted by a pusher 5 that defines a dispenser orifice. The body 4 is mounted in stationary and leaktight manner in the opening 13 of the shell 1. By pressing on the pusher 5, fluid is put under pressure in a pump chamber in such a manner as to force its contents through the pusher and the dispenser orifice. When the pusher is released, a return spring tends to return it to its rest position, thereby causing the volume of the pump chamber to increase and suction to be created therein that causes fluid from the reservoir R to be sucked up. Once again, this configuration and operating mode are entirely conventional for a pump in the fields of cosmetics, pharmacy, and even perfumery. As a result of the suction created in the reservoir, the follower piston 2 moves inside the slide cylinder 11 through a distance that corresponds to the volume of fluid sucked up by the dispenser member D.

In the invention, a separator element 3*a* is arranged inside the reservoir R, and more precisely inside the slide cylinder 11 so as to divide it into two compartments, namely a lower compartment Ri that is defined between the follower piston 2 and the separator element 3*a*, and an upper compartment Rs that is defined between the separator element 3*a* and the bottom face of the dispenser member D. However, the separator element 3*a* also defines a communication passage between the two compartments Ri and Rs. In the first embodiment in FIGS. 1 and 2*a*, the communication passage is formed by a through hole 33 that is formed directly in the separator element, e.g. at its center. The single through hole 33 may present any shape, e.g. annular as shown in the figures. In greater detail, the separator element 3*a* may be in the form of a disk that is perforated at its center with a through hole 33, and that, on its periphery, advantageously forms one or two sealing lips 31 in leaktight sliding engagement with the slide cylinder 11. It is also possible to envisage that the separator element 3*a* does not have a peripheral sealing lip 31, and that its contact with the slide cylinder 11 is not completely leaktight.

In the initial position, when the reservoir R is filled with fluid, the separator element 3*a* may be arranged mid-way between the follower piston 2 and the bottom face of the dispenser member D, for example. The lower compartment Ri may be filled with a first fluid, and the upper compartment Rs may be filled with another fluid. The two fluids come into contact with each other, e.g. at the through hole 33. However, so long as the dispenser member D is not actuated or so long as the follower piston 2 is not moved, the two fluids generally remain static and the interface between them remains at the through hole 33. The two fluids stored respectively in the two compartments Ri and Rs may be identical, but preferably they are different. The difference between the two fluids may be of any kind, e.g. a difference in viscosity, in color, in transparency/opacity, in composition, in physico-chemical properties, etc. Advantageously, the fluid of the lower compartment Ri presents viscosity that is lower than the viscosity of the fluid stored in the upper compartment Rs. Advantageously, the two compartments are filled entirely with fluid, such that there is no air therein.

While the dispenser member D is being actuated by pressing on the pusher 5, suction is generated in the reservoir R made up of the two compartments Ri and Rs. In response, the follower piston 2 moves, thereby also causing the interface between the two fluids to move. In other words, the fluid of compartment Ri may flow into the fluid of the upper compartment Rs through the through hole. Thus, a fraction of the first fluid of compartment Ri mixes with the fluid of compartment Rs in compartment Rs. This implies that the separator element 3*a* does not move through the same stroke as the follower piston 2. By way of example, it is possible to envisage that the separator element remains static relative to the slide cylinder 11 when the follower piston 2 moves. It is also possible to envisage that the separator element 3*a* moves, but through a distance that is shorter than the distance through which the follower piston 2 moves. The first fluid of the compartment Ri thus progressively flows into the compartment Rs in which it mixes with the second fluid, thereby creating a mixture that is homogeneous to a greater or lesser extent. As a function of the relative viscosity and/or density of the two fluids, by way of example it is possible to envisage that the first fluid of compartment Ri rises in compartment Rs through the second fluid in order to reach the dispenser member D. Numerous configurations for passing, mixing, and interpenetrating are possible as a function of the natures of the two fluids, and of the arrangement of the separator element, and of the configuration of the through hole(s) 33.

Figure 2A:
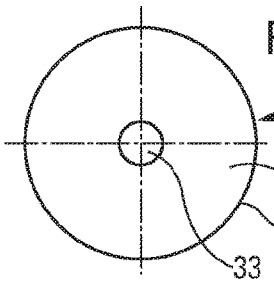
Figure 2B:
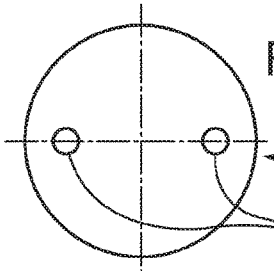
Figure 2C:
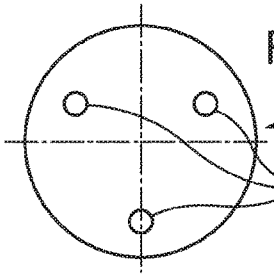

By way of example, reference may be made to FIGS. 2*b* and 2*c*, which show variant embodiments of the separator element: the separator element 3*b* in FIG. 2*b* includes two through holes 33, while the separator element 3*c* in FIG. 2*c* includes three through holes 33. The arrangement of the through holes and their size is given only by way of illustration.

Figure 3:
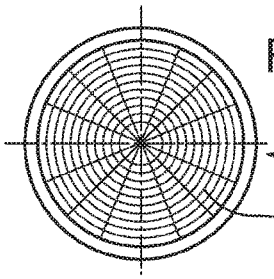

FIG. 3 shows another separator element 3*d* that is in the form of a mesh in the form of a spider's web. The separator element 3*d* thus defines numerous through holes having a combined surface area that may be greater than half of the total surface area of the separator element.

FIG. 4*a* also shows another separator element 3*e*, including a through hole that is fitted with a filter 33". By way of example, the filter 33" may serve to filter the fluid stored in the lower compartment Ri so as to separate its components. In other words, the separator element may have a filtering function.

Figure 5:
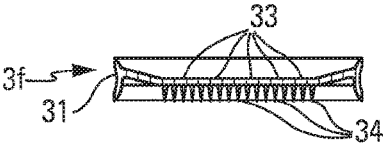
Figure 6:
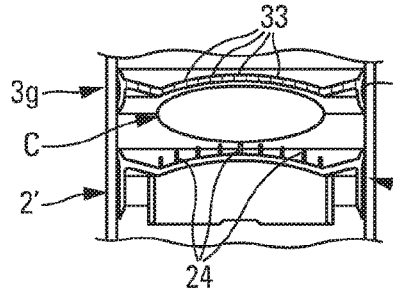
Figure 4:
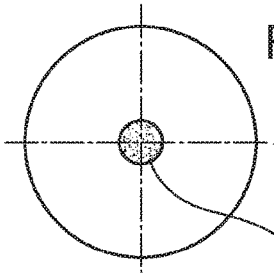

FIG. 5 shows another type of separator element 3*f* that is provided with a plurality of through holes 33, but that also includes perforator means in the form of spikes or teeth 34, e.g. formed on its bottom face. By way of example, the perforator means may serve to puncture a capsule C, as can be seen in FIG. 6. Specifically, FIG. 6 shows another embodiment in which the separator element 3*g* includes through holes 33, and it presents a shape that is slightly convex, making it possible to receive a capsule C containing a substance. Given that the separator element 3*g* does not include perforator means like the perforator means of the separator element 3*f*, it is necessary to fit the follower piston 2' with perforator means 24 in the form of spikes or teeth or pins 24. Thus, when the follower piston 2" approaches the separator element 3*g*, the perforator means 24 come into contact with the capsule C and puncture it. The substance that it contains thus mixes with the first fluid of the reservoir Ri before mixing with the second fluid of the compartment Rs after passing through the through holes 33. Thus, in the embodiments in FIGS. 5 and 6, the separator element may serve to puncture a capsule C at a given or desired instant.

Figure 7:
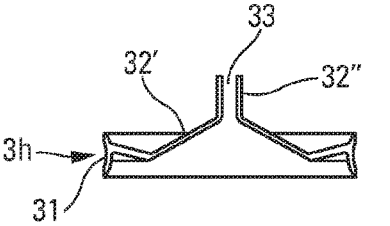

FIG. 7 shows another embodiment for a separator element 3*h* that is no longer in the form of a disk, but rather has a frustoconical portion 32' that is extended by a cylindrical portion 32" that forms the through hole 33. The purpose of this embodiment is to illustrate how the separator element may present a very wide variety of shapes, providing it defines two superposed compartments inside the reservoir R.

Although not shown, it is possible to envisage embodiments and applications in which the slide cylinder 11 contains not just one separator element, but a plurality of separator elements so as to define three or more compartments.

In FIG. 1, the reservoir R is provided with a follower piston 2 that moves when the reservoir is subjected to suction. Furthermore, the dispenser member D is preferably a pump. However, without going beyond the ambit of the invention, it is possible to make a dispenser incorporating the present invention and including a piston in a slide cylinder that is not a follower piston, but a pusher piston, e.g. that is resiliently biased by a spring or by a propellant gas. In this configuration, it is preferable to use a dispenser valve as dispenser member D. The separator element performs exactly the same role of separation and of communication between two compartments formed inside the reservoir.

By means of the present invention, a fluid dispenser is obtained having a single reservoir, but divided into a plurality of compartments that are separated by a separator element defining a communication passage. The fluids are mixed together during actuation of the dispenser that results in fluid being dispensed.

The invention claimed is:

1. A fluid dispenser comprising a fluid reservoir (R) and a dispenser member (D) that is mounted on the reservoir (R), the dispenser member (D) including a pusher (5) for actuating the dispenser member, the reservoir (R) forming a leaktight slide cylinder (11) and including a piston (2; 2') that slides in the cylinder (11) in response to the dispenser member (D) being actuated by pressing on the pusher (5), so as to decrease a working volume of the reservoir (R) and keep the working volume of the reservoir out of contact with the outside air;

wherein the leaktight slide cylinder (11) further contains a separator element (3*a*; 3*b*; 3*c*; 3*d*; 3*e*; 3*f*; 3*g*) that divides the reservoir into two compartments (Ri, Rs), namely a lower compartment (Ri) that is defined between the piston (2; 2') and the separator element (3*a*; 3*b*; 3*c*; 3*d*; 3*e*; 3*f*; 3*g*), and an upper compartment (Rs) that is defined between the separator element (3*a*; 3*b*; 3*c*; 3*d*; 3*e*; 3*f*; 3*g*) and the dispenser member (D), each of the two compartments being filled entirely with a respective fluid, such that there is no air therein, the separator element (3*a*; 3*b*; 3*c*; 3*d*; 3*e*; 3*f*; 3*g*) including at least one through hole (33; 33'; 33") that puts the two compartments (Ri, Rs) into communication with each other, the separator element (3*a*; 3*b*; 3*c*; 3*d*; 3*e*; 3*f*; 3*g*) moving in the leaktight slide cylinder (11) in response to the dispenser member (D) being actuated by pressing on the pusher (5) that results in the fluids from the reservoir being dispensed.

2. A dispenser according to claim 1, wherein the separator element (3*a*; 3*b*; 3*c*; 3*d*; 3*e*; 3*f*; 3*g*) slides in leaktight manner in the slide cylinder (11).

3. A dispenser according to claim 1, wherein the fluid of the lower compartment (Ri, Rs) is different from the fluid in the upper compartment.

4. A dispenser according to claim 3, wherein the fluid of the lower compartment (Ri) presents viscosity that is lower than the viscosity of the fluid of the upper compartment (Rs).

5. A dispenser according to claim 1, wherein the separator element (3*a*; 3*g*) moves simultaneously with the piston (2; 2').

6. A dispenser according to claim 1, wherein the separator element (3*d*) includes a filter (33").

7. A dispenser according to claim 1, wherein the lower compartment (Ri) contains microcapsules that are broken on passing through the at least one through hole (33).

8. A dispenser according to claim 1, wherein the lower compartment (Ri) contains at least one capsule (C) containing a substance, and the separator element (3*e*) and/or the piston (2') includes perforator means (34; 24) that are suitable for perforating the capsule (C) so as to diffuse the substance in the reservoir.

9. A dispenser according to claim 1, including a plurality of separator elements that are superposed in the cylinder (11) in such a manner as to divide the reservoir into three or more compartments.

10. A dispenser according to claim 1, wherein the separator element (3*a*; 3*b*; 3*c*; 3*d*; 3*e*; 3*f*; 3*g*) is in the form of a disk with at least one leaktight-sliding lip (31) on an outer periphery of the disk.

11. A dispenser according to claim 1, wherein the separator element (39) includes a portion that is conical (32') and/or cylindrical (32").

12. A dispenser according to claim 1, wherein the piston (2; 2') is a follower piston that moves when the reservoir (R) is subjected to suction, or a pusher piston that is resiliently biased by a spring or by a propellant gas.

13. The dispenser according to claim 1, wherein the dispenser member is a pump.

14. The dispenser according to claim 1, wherein the at least one through hole of the separator element puts the two compartments into direct fluid communication with each other.

15. The dispenser according to claim 1, wherein the at least one through hole of the separator element puts the two compartments into fluid communication with each other within the upper compartment.

16. The dispenser according to claim 1, wherein the at least one through hole of the separator element puts the two compartments into fluid communication with each other upstream of the dispenser member, such that the fluid from the lower compartment that passes through the at least one through hole mixes with the fluid in the upper compartment and within the upper compartment prior to entering the dispenser member.

17. The dispenser according to claim 1, configured to allow the fluid of the lower compartment to enter the upper compartment through the at least one through hole.

18. The dispenser according to claim 1, wherein the fluid from the lower compartment that passes through the at least one through hole of the separator element mixes with the fluid form the upper compartment within the upper compartment.

19. The dispenser according to claim 1, wherein the at least one through hole is directly formed in the separator element.

* * * * *